United States Patent [19]

Goss

[11] 4,243,249

[45] Jan. 6, 1981

[54] DOCUMENT HOLDER ASSEMBLY

[76] Inventor: H. Calvin Goss, 8035 Brittany Pl., Pittsburgh, Pa. 15235

[21] Appl. No.: 897,974

[22] Filed: Apr. 20, 1978

[51] Int. Cl.[3] ..... B42D 17/00

[52] U.S. Cl. ..... 281/1; 248/444; 281/15 A; 281/15 B; 281/45; 108/43

[58] Field of Search ..... 248/444, 447, 451; 402/70; 24/3 A, 3 M, 3 R, 67.5; 281/45, 1, 15 R, 15 A, 15 B; 283/1; 108/28, 43, 139

[56] References Cited

U.S. PATENT DOCUMENTS

| | | | |
|---|---|---|---|
| 1,039,900 | 10/1912 | Collis | 24/3 M |
| 1,199,063 | 9/1916 | Fleich | 108/139 |
| 1,264,295 | 4/1918 | Greene | 24/3 M |
| 1,407,239 | 2/1922 | Weiss | 108/43 X |
| 1,628,013 | 5/1927 | Twedt | 108/139 |
| 1,930,478 | 10/1933 | Jones | 108/43 X |
| 2,661,222 | 12/1953 | Wolfe | 281/1 |
| 2,701,173 | 2/1955 | Senior et al. | 248/444 X |
| 2,876,022 | 3/1959 | Kroviak | 248/444 X |
| 3,215,453 | 11/1965 | Malcom, Jr. | 108/43 X |
| 3,543,977 | 12/1970 | Lockridge | 248/444 X |
| 3,620,498 | 11/1971 | Tunkl | 281/1 X |

FOREIGN PATENT DOCUMENTS

| | | | |
|---|---|---|---|
| 710009 | 9/1941 | Fed. Rep. of Germany | 281/1 |

*Primary Examiner*—Paul A. Bell

*Attorney, Agent, or Firm*—Thomas H. Murray; Clifford A. Poff

[57] ABSTRACT

A document holder and position locator assembly is provided for use by a pilot or navigator to maintain a log and for access to flight or ground data. The assembly includes a releasable strap fastener to attach the concave surface of a support base onto the top thigh portion of a pilot or navigator while seated. A carrier plate is permanently connected by a centrally-located pivot to the support base. Flight plans, maps and similar documents are held onto the carrier plate by releasable clamps secured along two adjoining sides of the carrier plate for orientation by rotation of the plate.

3 Claims, 5 Drawing Figures

DOCUMENT HOLDER ASSEMBLY

BACKGROUND OF THE INVENTION

This invention relates to a document holder assembly particularly adapted for use by a pilot on a small aircraft and/or a navigator to both maintain a log and for access to flight plan data including, for example, instrument approach charts through rotational positioning of documents while carried upon a support surface.

Numerous sheets of paper containing essential data for the flight of an aircraft are utilized, some at different times, during the flight. These sheets of paper include, for example, a flight plan, radio communication frequencies, approach charts for the landing, taxiing and takeoff from airports, together with other statistical data in printed or log record form. Because of the number of different documents involved, it is particularly useful and desirable to centralize their location for ready access by a pilot and/or navigator of an aircraft, particularly a small aircraft. In addition to the problem of providing a convenient central location for the various documents used during the flight of an aircraft, there is the attending problem that approach charts cannot be readily oriented to coincide with the flight path by the aircraft. However, space within the cockpit of an aircraft is judiciously utilized to the greatest extent for instrumentation and controls. Thus, space is not usually available to post, for example, a 5×7 inch approach chart within the line-of-sight by personnel in the aircraft without obscuring instrumentation and/or controls.

SUMMARY OF THE INVENTION

It is an object of the present invention to provide a document holder assembly for use by personnel on board an aircraft, such as a pilot and navigator, to maintain a log and for access to documents including a flight plan, ground data and instrument approach charts while always remaining within a line-of-sight.

It is a further object of the present invention to provide a document holder assembly adapted to releasably hold documents upon a surface suitable for writing, while at the same time, providing that such surface is rotatable so as to orientate chart information to coincide with the actual heading of the aircraft.

More specifically, according to the present invention, there is provided a document holder assembly for use by personnel such as a pilot and a navigator on board an aircraft to maintain a log and for access to documents including a flight plan or the like wherein the holder assembly includes the combination of a support base, strap means engaging the support base for attachment of the support base at a desired location, a carrier plate having a rigid face surface to support documents for continuous accessible use by the personnel, document clamp means secured to the carrier plate at a side thereof to releasably retain a document on the face surface of the carrier plate and a pivot to interconnect the carrier plate and the support base in a superimposed manner for rotational positioning of the document while retained on the carrier plate by the clamp means relative to the support base.

In the preferred form of the present invention, two document clamp members are secured to the carrier plate along adjoining sides thereof. The support base is preferably concave so as to provide a hollowed surface area to releasably engage the thigh portion of the pilot or other personnel by means of the strap means. In this way, the support base is retained and supported against rotational movement while at the same time the base provides adequate support for rotational movement by the carrier plate about the pivot. The pivot, in one form, essentially includes a flathead machine screw arranged such that the head portion and the threaded portion are each supported by a different one of the support base and the carrier plate. The pivot according to a second embodiment includes a pivot shaft having an enlarged head at one end retained by the carrier plate. A recess in the other end of the pivot shaft extends into an opening in the support base where an internal flange on a retainer ring is received in the recess. An external flange on the retainer ring engages the side of the support base which is opposite the face surface of the carrier plate.

These features and advantages of the present invention, as well as others, will be more fully understood when the following description is read in light of the accompanying drawing, in which.

Figure 1:
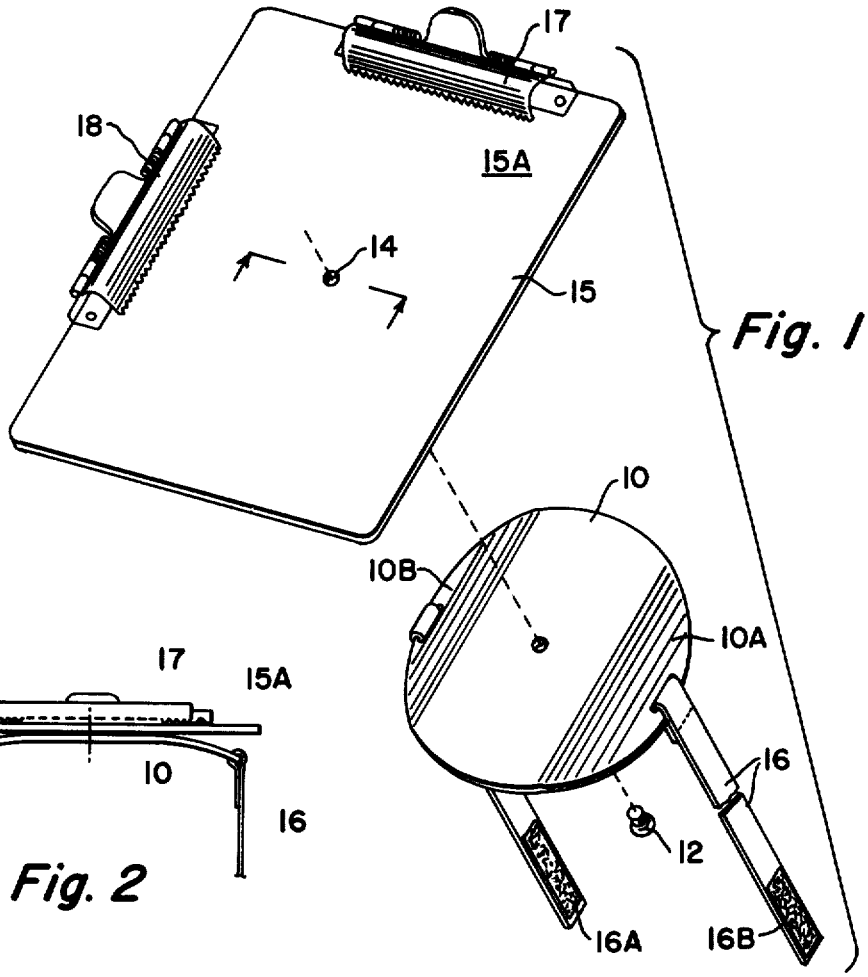
FIG. 1 is an exploded perspective view of the parts forming the document holder assembly of the present invention.
Figure 2:
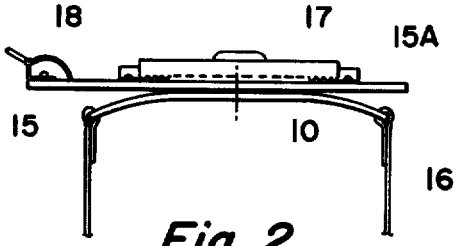
FIG. 2 is a side elevational view of the holder assembly shown in FIG. 1 but in an assembled form.
Figure 3:
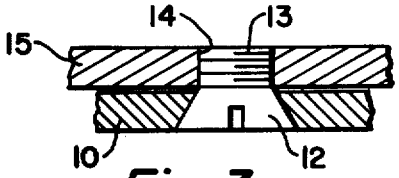
FIG. 3 is a sectional view taken along line III—III of FIG. 1.

As shown in FIGS. 1 and 2, support base 10 takes the form of a plate with a generally circular configuration and provided with a centrally-located opening 11. As shown in FIG. 3, the opening 11 is chamfered so that the head portion 12 of a flathead machine screw 13 is flush with the lower face surface of the support base. The threaded portion of machine screw 13 projects from the support base and the threads are received within a tapped hole 14 located in the central part of a rectangularly-shaped carrier plate 15. The support base 10 has downwardly-bent edge portions 10A and 10B along diametrically-opposite sides thereof. A strap fastener assembly 16 which may be of any convenient form has free ends secured within slotted openings in the edge portions 10A and 10B. The remaining free ends of the strap assembly 16 are joined together through a clasp such as a buckle but preferably a fastening system consisting of a pad 16A of pile fabric and a pad 16B of plastic hooks.

Figure 5:
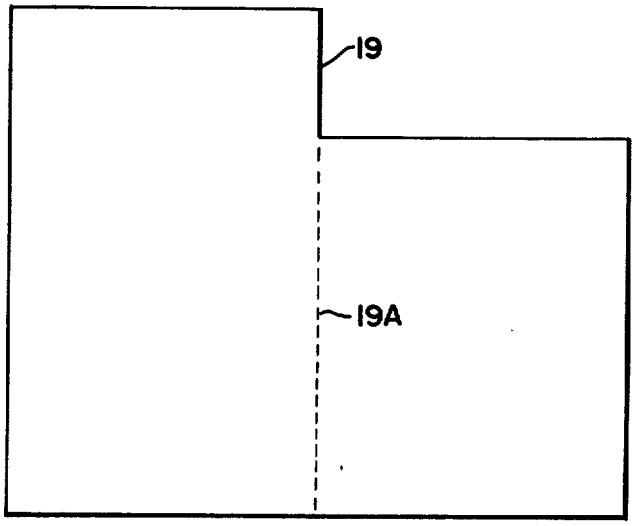
FIG. 5 is a plan view of a convenient format to form a flight plan document for use with the document holder assembly of the present invention.

As best shown in FIGS. 1 and 2, the edge portions 10A and 10B are bent away from carrier plate 15 and form a hollowed support surface which is dimensioned to conform to the thigh of a person while in the sitting position. Thus, it is preferred according to the present invention to support the holder assembly upon the leg portion of personnel on board an aircraft whereby the holder assembly is always within the line-of-sight of that person. After the holder assembly is positioned, the strap assembly 16 is used to retain the assembly at the desired location. At this location, the carrier plate 15 is rotatable about the pivot provided by the flathead machine screw 13. This pivotal movement provides the desired positioning of documents retained on the face surface 15A of the carrier plate 15. Document clamp assemblies 17 and 18 are secured by threaded fasteners or the like along two adjoining sides of the carrier plate. It is preferred to employ two such document clamp members. As shown in FIG. 5, a document in the form of a piece of paper 19 is folded along a fold line 19A whereby the folded paper has a projected heading portion above the folded-over portion. The projected head portion is readily attached to the carrier plate 15 through the use of clamp assembly 17. All four face surfaces of the folded sheet of paper 19 are then accessible by opening of the folded portion about the fold line. Moreover, the paper can be lifted while attached by clamp assembly 17 to expose an approach chart document which is independently retained on the carrier plate by clamp assembly 18. Thus, the paper 19 is a convenient configuration of a log and flight plan since four sides of the folded paper 19 are usable through rotational positioning of the carrier plate. Moreover, the carrier plate can be conveniently positioned at any time so that the approach heading shown, for example, on an approach chart can be orientated to correspond to the line-of-flight of the aircraft.

Figure 4:
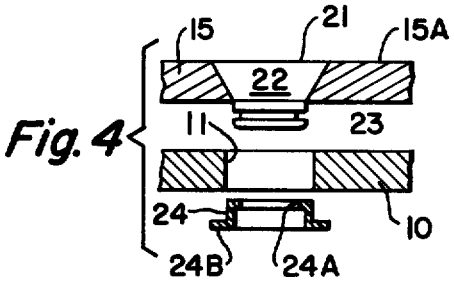
FIG. 4 is an exploded view showing an arrangement of parts to form an alternative form of a pivot for use in the document holder assembly of the present invention.

FIG. 4 illustrates a modified form of a pivot to interconnect the carrier plate 15 and support base 10. The pivot shown in FIG. 4 essentially includes a stud 21 having an enlarged chamfered head 22 passed into a tapered opening in the carrier plate 15 to provide a flush, smooth surface that is part of the document support surface 15A. The projected end of the stud 21 has a recess 23 arranged along the shank portion of the stud to lie within the bored opening 11 in the support base 10. After the support base is moved into a position directly beneath the carrier plate 15, a retainer ring 24 is snapped into place. This is accomplished by providing on the retainer ring an internal flange 24A that passes into the recess 23. An external flange 24B engages the lower face surface of the support base opposite the carrier plate.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A document holder assembly for use by personnel such as a pilot and navigator on board an aircraft to maintain a log and for access to documents including a flight plan, approach charts or the like, said holder assembly including the combination of:

a support base including bent edge portions at opposite sides each having a strap-receiving opening, strap means engaging the strap-receiving opening in said support base for attachment thereto for support at a desired location, a carrier plate having a rigid face surface to support said documents for continuous accessible use by said personnel, two document clamp members secured to said carrier plate to extend along two adjoining sides thereof to releasably retain individual documents while superimposed on the face surface of the carrier plate whereby lifting of the upper document while retained by one document clamp member exposes an underlying document while retained by the other document clamp member, and a pivot to interconnect said carrier plate and said support base in a superimposed manner for rotational positioning of documents while retained on the carrier plate by said clamp members relative to said support base.

2. The holder assembly according to claim 1 wherein said pivot includes a pivot shaft having an enlarged head at one end and a recess at the other end, a retainer ring having internal and external flanges, said internal flange being received in said recess, the arrangement of parts being such that the enlarged head and retainer ring are supported by different ones of said support base and said carrier plate.

3. The holder assembly according to claim 1 wherein said pivot includes a flathead machine screw supported by the threads of a tapped hole in said carrier plate while the head portion of the screw is seated within a chamfered recess in said support base.

* * * * *